United States Patent [19]

Zanoni et al.

[11] 4,128,003

[45] Dec. 5, 1978

[54] ACOUSTIC COUPLERS FOR HOROLOGICAL CALIBRATION INSTRUMENTS

[75] Inventors: Louis A. Zanoni, Trenton; James W. Pollack, New Egypt, both of N.J.

[73] Assignee: Zantech, Inc., Trenton, N.J.

[21] Appl. No.: 761,261

[22] Filed: Jan. 21, 1977

[51] Int. Cl.[2] ..... G04C 21/00

[52] U.S. Cl. ..... 73/6

[58] Field of Search ..... 73/6; 58/35 W, 24–26, 58/38 R, 57.5

[56] References Cited

U.S. PATENT DOCUMENTS 4,030,337 6/1977 Bichsel ..... 73/6

*Primary Examiner*—Donald O. Woodiel

*Attorney, Agent, or Firm*—Arthur L. Plevy

[57] ABSTRACT

Apparatus is disclosed which is employed to provide an audible sound at a given repetition rate to enable one to test and calibrate a timing mechanism such as a watch which employs a non-audible frequency source, such as a crystal or quartz oscillator. The apparatus employs a pickup antenna and tuned circuit means which are responsive to the frequency radiated by the oscillator employed in the horological device to be tested. This frequency is processed by means of suitable circuitry to provide an output frequency within the audible range and of a repetition rate consistent with the repetition rate of a prior art mechanical horological device. The output frequency signal is applied to an audio transducer to thus provide an audible signal which is synchronized to the crystal oscillator signal to thereby enable a user to employ a prior art calibration instrument for testing and calibration of the above noted devices.

10 Claims, 1 Drawing Figure

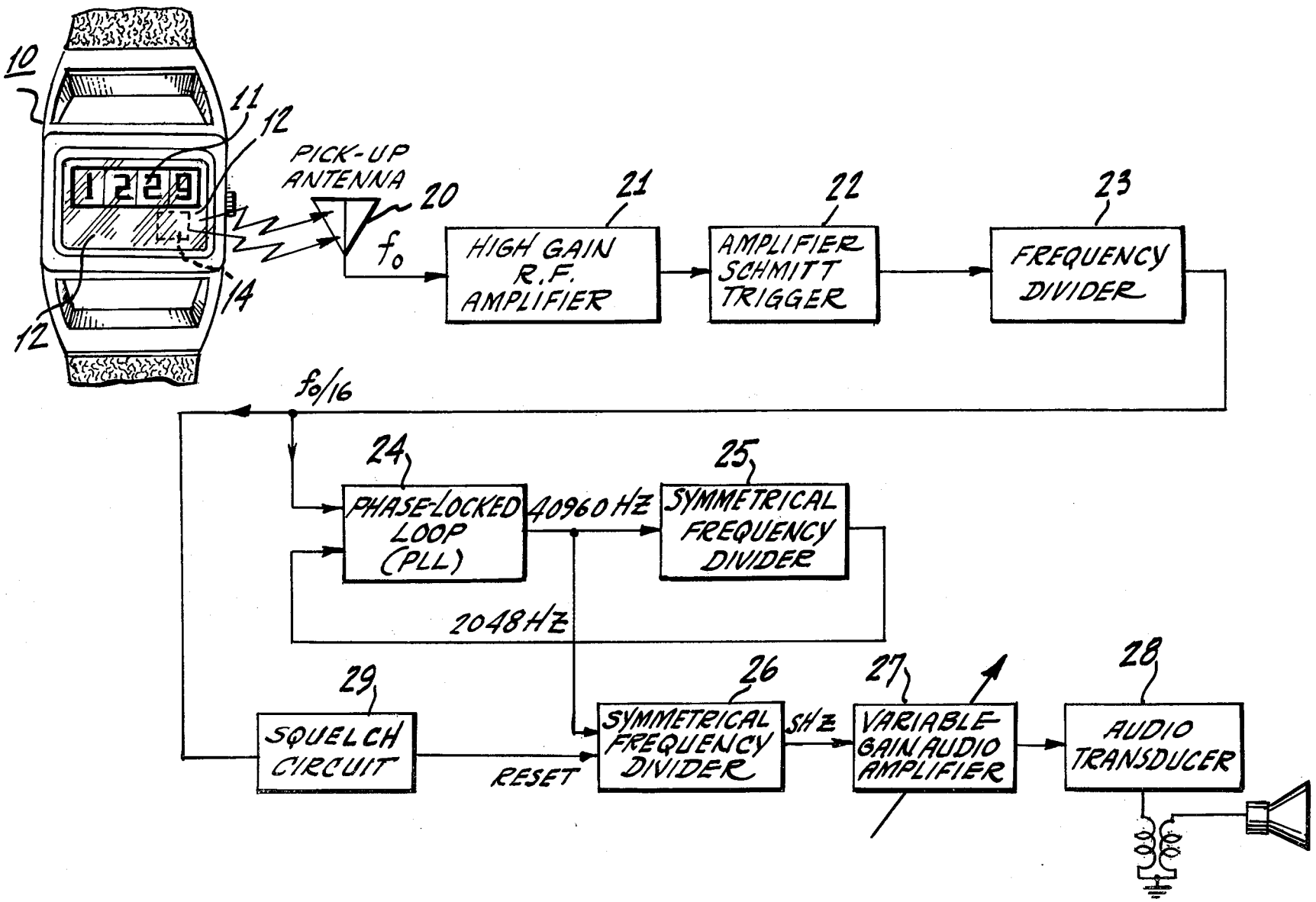
10
11
12
12
14
PICK-UP ANTENNA
20
$f_0$
21
HIGH GAIN R.F. AMPLIFIER
22
AMPLIFIER SCHMITT TRIGGER
23
FREQUENCY DIVIDER
$f_0/16$
24
PHASE-LOCKED LOOP (PLL)
40960 HZ
2048 HZ
25
SYMMETRICAL FREQUENCY DIVIDER
26
SYMMETRICAL FREQUENCY DIVIDER
SHZ
RESET
29
SQUELCH CIRCUIT
27
VARIABLE-GAIN AUDIO AMPLIFIER
28
AUDIO TRANSDUCER

ACOUSTIC COUPLERS FOR HOROLOGICAL CALIBRATION INSTRUMENTS

BACKGROUND OF INVENTION

This invention relates to an acoustic coupler and more particularly to apparatus for converting a high frequency signal available from an oscillator in an electronic watch to an audible tone which has a repetition rate indicative of those rates employed in mechanical watches.

Presently, there exists a great numer of devices which are employed in the horological industry for calibrating and testing the timing accuracy of watches and clocks. Due to the fact that a vast majority of watches are mechanical devices, these instruments are primarily adapted to test and calibrate the typical conventional mechanical timepiece.

As is well known, a mechanical timepiece provides an audible ticking which of course, relates to the accuracy or ability of the timepiece to provide an accurate indication of the time of day. The ticking as one can ascertain, is at a relatively fixed repetition rate and as indicated, is an accurate measurement of the timing instrument's ability to indicate the correct time. Hence, many existing calibration instruments employ a microphone or acoustical pickup which converts the audible ticks to an electrical signal. The watch is placed on a platform or in the vicinity of such an acoustical pickup or transducer and the ticks are then responded to.

The timing device has an internal frequency standard which is used as a reference. The timing instrument operates to compare the repetition rate of the reference with the repetition rate of the ticking. If they are in adjustment, a tape or permanent record will indicate this factor to the operator. For example, in many such instruments, if the timepiece is accurately calibrated, a tape printout will provide a straight line during the testing operation. If there is a deviation in frequency between the standard and the timepiece, the line printout will be at a positive or negative slope depending upon the nature and magnitude of the frequency drift. The operator can therefore adjust the timing mechanism until a straight line printout is achieved and hence, he can thus be assured that the timepiece is accurate within predetermined limits as depending upon the accuracy of the frequency standard included in the calibration instrument.

In any event, based on the great strides made in the field of integrated circuits and displays, there are an increasing number of watches and timepieces on the market which do not in any manner produce an audible tick. In general, such devices are designated according to the types of displays employed to provide an indication of the time of day and are referred to as LED, LCD, and so on. These devices employ a crystal oscillator which is an electronic circuit and provides an extremely accurate and stable output frequency signal.

A great majority of these watches employ such an oscillator operating at an output frequency of 32,768.00Hz or 32.768kHz. Other devices employ an oscillator with an output frequency of 786.483kHz. It is, of course, ascertained that both frequencies are not within the audible range. These frequencies are used as standards in the timing instrument and are conventionally divided to provide, for example, a one cycle per second signal which is synchronized to the oscillator frequency and therefore of the same accuracy. This signal is then counted and displayed to provide an indication of the time. The functioning and operation of such electronic devices are well known in the state of the art.

There is, of course, a problem in that the above described calibration devices which have been employed for calibrating mechanical watches cannot be used in conjunction with the above noted electronic timepieces. Hence, there are available a number of different timing instruments to be used with electronic watches. These are, in general, more expensive than the prior art mechanical calibration devices and employ different pickups and may possess, for example, both the capability of testing mechanical devices and electronic devices. Thus, such an instrument with the dual capability of calibrating both mechanical and electronic devices is more expensive than the prior art mechanical tester and requires a different discipline for use.

As indicated above, a typical mechanical device which provides a ticking will conventionally provide a ticking repetition rate of five or 10 ticks per second, as these rates are associated with reliable mechanical timing apparatus. The persons employed in the watchmaking industry are used to this repetition rate and tend to relay on the ticking to aid in calibrating the device in conjunction with the calibration instrument. Furthermore, such persons also possess a great deal of experience and knowledge gained through many years to thus enable them to reliably and effectively employ the prior art calibration instruments for such mechanical devices.

It is therefore an object of the present invention to provide apparatus for converting the crystal oscillator frequency employed in an electronic timepiece to an audible frequency having a repetition rate indicative of a mechanical timepiece to therefore enable a user to employ a prior art mechanical calibration instrument to test and calibrate electronic timepieces.

BRIEF DESCRIPTION OF PREFERRED EMBODIMENT

Apparatus for converting a radiated high frequency output signal from a reference oscillator employed in an electronic timepiece to an audible signal corresponding to the ticking rate of a conventional mechanical timepiece comprising pickup means responsive to said radiated signal to provide at an output an amplified version of said high frequency radiated signal, means coupled to said pickup means and responsive to said amplified signal to provide at an output, a low frequency signal synchronized to said radiated signal and of a repetition rate relatively equal to the rate of ticks per second of a mechanical timepiece, and audio transducing means responsive to said low frequency signal to provide an audible output signal manifesting the ticking of a mechanical timepiece.

BRIEF DESCRIPTION OF THE FIGURE

The sole FIGURE is a block diagram of an acoustic coupler according to the invention.

DETAILED DESCRIPTION OF THE FIGURE

Referring to the figure, there is shown a typical electronic watch module 10. It is understood that the module 10 may be a wrist watch, a wall clock or any other suitable device which employs electronic curcuitry to provide timekeeping.

The timepiece 10 is associated with a display 11 which may be an LED or LCD display for providing the user with a digital indication of the time. The timepiece is normally encased in a suitable housing with a clear plastic or glass front 12 to enable a user to view the time and to provide a dust-free enclosure for the electronic circuitry incorporated in the timepiece.

As indicated above, such timepieces include an internal oscillator 14 which provides a relatively high frequency stable signal. This signal is then suitably processed by the watch circuitry to provide a timekeeping signal which is counted and displayed to give an indication of the time of day. Due to the nature of the oscillator 14 in regard to the operating frequency, there is a sufficient amount of radiation of the operating frequency from the case 10 supporting and housing the electronics. The radiation is particularly strong in the vicinity of the glass panel 12 and can be measured and detected by external means.

As indicated, most electronic watches presently in existence have an oscillator 14 which may be a crystal or quartz oscillator operating at a frequency of 32.768kHz. Certain other electronic devices employ an oscillator which operates at a higher frequency of 786.483kHz. It is noted that the frequency of 32.768kHz is capable of being processed or divided by binary dividers into integral factors to therefore enable one to employ symmetrical bistable or other digital dividing circuits to provide repetition rates capable of being suitably processed for timekeeping purposes.

In any event, the frequency of the oscillator is radiated into free space and can be, as indicated, measured and detected.

Shown adjacent the timepiece 10 is a pickup antenna 20. The antenna 20 may be a relatively short piece of wire or a strip-line serpentine antenna. The function of the antenna 20 is to respond to the oscillator radiation to enable coupling of this radiation to a suitable input circuit 21.

The input circuit 21 is a relatively high gain radio frequency amplifier which may consist of one or more tuned stages, each employing an active device such as a field effect transistor and a tuned circuit having a relatively high Q. The RF amplifier operates to selectively amplify the radiated oscillator signal developed in the antenna 20 coupled to the input thereof. Techniques for fabricating and designing such high gain RF amplifiers as 21 are known in the art.

For example, the input from antenna 20 at the radiated frequency may be of the order of one to ten microvolts depending upon the particular watch and so on. The RF amplifier 21 provides a suitable voltage gain at the radiated frequency and hence, the output signal would be two hundred or more millivolts. It is noted that the tuned amplifier 21 due to the selectively tuned circuits, would tend to discriminate against spurious frequencies which also may be radiated from the timepiece 10.

The output of the RF amplifier 21 is coupled to the input of a Schmitt trigger 22. The Schmitt trigger is a well known circuit and may be fabricated from bipolar or field effect devices or can be purchased as an integrated circuit. Basically, the Schmitt trigger will provide an output each time the input signal reaches a predetermined level. In case of a sine wave signal applied to the input of the Schmitt trigger 22, the output will provide a pulse train of the same repetition rate as the sine wave, but having much faster rise and fall times due to the nature of the Schmitt trigger.

As indicated, such devices exist as integrated circuit components and can be supplied. For examples of Schmitt trigger circuits, reference is made to a text entitled APPLICATIONS OF LINEAR INTEGRATED CIRCUITS by Eugene R. Hnatek published in 1975 by John Wiley & Sons, pages 238, 249 and 255. Many examples of Schmitt trigger circuits are known in the art.

As indicated, the function of the Schmitt trigger 22 is to provide a fast rise time pulse train with a repetition rate equal to that of the radiated frequency. This fast rise time is necessary to enable the utilization of integrated circuit frequency divider components or chains of cascaded binary multivibrators.

The output of the Schmitt trigger is coupled to the input of a binary divider chain or frequency divider 23. The divider chain 23 produces an output pulse for every sixteen input pulses and hence, provides an effective division of the radiated frequency of sixteen in this particular example.

It is, of course, understood that other division ratios for other frequencies can be implemented as will be apparent to one skilled in the art.

The output of the frequency divider 23 is applied to one input of a phase locked loop 24. The phase locked loop is also a well known circuit component and exists as an integrated circuit package available from many suppliers of such circuits.

Basically, the phase locked loop or PLL is also explained in the above noted text on pages 496–512. In essence, a basic phase locked loop consists of a phase detector, a low pass filter and a voltage controlled oscillator (VCO). The voltage controlled oscillator is synchronized to an incoming signal and enables the oscillator to lock to the input signal to produce at its output, a frequency which is exactly synchronized to the input signal.

In this particular case, the phase locked loop employs an internal oscillator (VCO) which operates at an output frequency of 40960Hz. It is noted at the onset, that this frequency while related to the radiated frequency of 32.768kHZ by a given integer, is selected for other reasons. A reason for selecting the frequency of the VCO in the phase locked loop in this manner, is to enable one to acheive a final output frequency at a rate of 5Hz which identically corresponds to 10 ticks per second, associated with a great many mechanical watches and as described above.

It is, of course, noted that the frequency of the VCO if divided by twenty provides an output frequency of 2048. It is also noted that the radiated frequency of 32.768 if divided by 16 provides an output of 2048. Hence, these frequencies as related are compared in the phase detector, as will be explained, to control the VCO.

It is important to note that the radiated frequency cannot be divided to provide a 5Hz signal, which signal is indicative of a typical tick rate of a prior art mechanical watch or clock and hence, one is required to provide a signal sychronized to the radiated timepiece signal in order to accommodate the 5Hz required. This signal is, of course, obtained from the output of the VCO as will be explained.

A functional description of the phase locked loop 24 will be described using the frequencies indicated above by way of example only. It is clearly understood that by employing different techniques or multiples in regard to dividers and operating frequencies of the phase locked loop, one could acheive identical results and the above factors are given by way of example.

Let us assume that the radiated frequency is 32.768kHz. In this manner, the output of the frequency divider 16 would be 2048Hz.

Shown coupled to the output of the phase locked loop is a symmetrical frequency divider 25. The divider 25 serves to provide a symmetrical signal at its output, which in this case is the VCO signal divided by a factor of 20. Hence, since the VCO signal is at 40960Hz, the output of divider 25 is at 2048Hz. Thus, this divided signal from the divider 25 and the signal from divider 23 are compared in a phase detector which is part of the loop 24. If there is any difference between the two signals, an error voltage is developed which controls the oscillator to cause its frequency to vary according to the differences. Thus, the output frequency of the oscillator is always synchronized to the input radiated frequency which is, of course, sychronized to the output of divider 23. In this manner, the output of the phase locked loop 24 is sychronized to the radiated frequency available at antenna 20. This output frequency from phase locked loop 24 is applied to the input of a frequency divider 26. The frequency divider 26 operates to divide the phase locked loop signal by a factor of 8,192. Such dividers are available in integrated circuit configurations and can provide divisions of 8,000 and greater by employing digital counting chains of suitable length to enable large magnitude binary division.

As one can then ascertain, the output of the phase locked loop which is 40960Hz if divided by 8,192 would provide an output frequency from divider 26 of 5Hz. This, of course, is the equivalent to five ticks per second as would be available in most mechanical watches. It is, of course, understood that certain mechanical watches can provide 10 ticks per second and if this would be preferable, then divider 26 need only divide by a factor of 4096Hz to provide at its output a frequency with a repetition rate of 10Hz.

The output signal from divider 26 is then applied to the input of a variable gain audio amplifier 27. The audio amplifier 27 is also a well known circuit and many examples of suitable amplifiers are known and used in the art.

One output of the audio amplifier 27 is coupled to the input of an audio transducer 28 which may be a typical hearing aid transducer or a ceramic speaker or microphone. There are many examples of suitable transducers which will provide an audible output upon application of a suitable audio signal thereto.

Thus, as can be ascertained, the output from transducer 28 is an audible signal which is synchronized to the radiated frequency of the timepiece 10 and is of a repetition rate completely compatible with a mechanical watch.

Essentially, the apparatus has therefore provided a ticking which is immediately associated with an electronic watch. The transducer 28 would then be placed in the vicinity or on a platform of a typical prior art calibration device and the operator would therefore be able to calibrate the timepiece 10 as if it were a mechanical device.

Such devices as 10 employ a variable component in conjunction with the oscillator to enable variations of the radiated frequency for purposes of such calibration. While many such timing mechanisms exist, an example of such a suitable type device is known as the LR Micromat which is manufactured by the L&R Manufacturing Co. of Kearny, N.J. There are, of course, many other such devices for calibration of mechanical watches which are made by others and which operate by being responsive to the audible ticks to thus calibrate a timing instrument.

As indicated above, these devices have a tape or other display which compares the ticks with an internal frequency standard. Therefore, if the ticks are synchronized to the internal standard, the printout is a straight line and if they deviate in one direction or another, the printout is a sloped line. Such devices have a platform or transducer upon which the watch is positioned and the printout operates when the watch is positioned on the platform.

Referring back to the FIGURE, there is shown a squelch circuit 29 which has its input coupled to the output of frequency divider 23 and has an output coupled to a reset input of frequency divider 26. The squelch circuit 29 is merely a peak detector or rectifier circuit which provides a DC voltage output proportional to the magnitude of the signal from frequency divider 23. As long as the frequency divider 23 provides an output, the squelch circuit 29 enables the frequency divider 26 to operate. If there is no output from frequency divider 23, the squelch circuit provides an output which resets the divider 26 and keeps the divider reset until divider 23 begins to operate. In this manner, if divider 26 is inhibited by the squelch circuit 29 when divider 23 is not operating, there will be no audible output from transducer 28 and hence, the tape mechanism or display in a typical calibration instrument will not advance.

The reason for the squelch circuit 29 is that the phase locked loop 24 operates whether or not the divider 23 is operating; and as can be ascertained from the circuit diagram, if the divider 26 were not inhibited, it would produce an output signal even though there is no radiated signal being received by antenna 20.

There are, of course, many ways of preventing the divider from operating during the absence of a radiated signal as well as other ways of inhibiting the 5Hz signal, which should be apparent to those skilled in the art.

As can be ascertained by the above description, the circuit components described are mainly available in integrated circuit form at extremely reasonable prices and hence, the complete circuit depicted in the FIGURE is extremely reasonable in cost and therefore can be provided as an accessory to a calibration device at an extremely reasonable price.

The apparatus depicted thus enables a user to employ existing and available instrumentation for the calibration of electronic watches in the same manner and procedure as used for mechanical devices. As indicated above, this factor is achieved by converting the radiated oscillator signal of an electronic timepiece to audible ticks having relatively the same repetition rate as the ticking provided by a mechanical timepiece.

We claim:

1. Apparatus for converting a radiated high frequency output signal from a reference oscillator employed in an electronic timepiece to an audible signal corresponding to the ticking rate of a conventional mechanical timepiece, comprising:

(a) pickup means responsive to said radiated signal to provide at an output, an amplified version of said high frequency radiated signal, (b) means coupled to said pickup means and responsive to said amplified signal to provide at an output a low frequency signal synchronized to said radiated signal and of a repetition rate relatively equal to the rate of ticks per second of a mechanical timepiece, and (c) audio transducing means responsive to said low frequency signal to provide an audible output signal manifesting the ticking of a mechanical timepiece.

2. The apparatus according to claim 1 wherein said pickup means responsive to said radiated signal includes an antenna of a configuration adapted to respond to said radiated signal to provide at an output, a signal according to said radiated signal, a tuned amplifier having an input coupled to said antenna output for providing at an output, an amplified version of said radiated signal and a Schmitt trigger having an input coupled to said output of said tuned amplifier to provide at an output a pulse train of a repetition rate equal to said frequency of said radiated signal.

3. The apparatus according to claim 1 wherein said means coupled to said pickup means includes a phase locked loop employing a voltage controlled oscillator (VCO) operating at a given frequency capable when divided by a given integer of providing a frequency relatively equal to the rate of ticks per second of a mechanical timepiece, said phase locked loop responsive to said amplified signal to synchronize said VCO thereto, whereby said VCO provides an output signal at said given frequency synchronized to said radiated signal, and means for dividing said output signal by said given integer to provide said low frequency signal.

4. The apparatus according to claim 3 wherein said VCO given frequency is relatively about 40.960kHz, said radiated signal frequency is relatively about 32.768kHz and said given integer is 8192 to provide said low frequency signal of 5Hz, which frequency is relatively equal to the rate of said ticks per second.

5. The apparatus according to claim 2 further including a frequency divider having an input coupled to said output of said Schmitt trigger and an output coupled to an input of said phase locked loop to provide at said input of said phase locked loop, another frequency synchronized to said radiated frequency and different therefrom by said division factor of said frequency divider.

6. The apparatus according to claim 3 further comprising:

a large factor frequency divider having an input coupled to said phase locked loop and operative to divide said VCO frequency by said given integer to provide at an output, said frequency relatively equal to the rate of ticks per second, and an audio amplifier having an input coupled to said output of said divider for providing at an output an amplified version of said frequency relatively equal to said rate of ticks per second.

7. The apparatus according to claim 6 further comprising means coupled to said large factor divider responsive to said amplified signal being provided to provide an ouput control signal during the presence of said amplifier signal to enable said divider to operate and to disable said divider when said amplified signal is not available.

8. The apparatus according to claim 5 wherein said frequency divider coupled to said Schmitt trigger divides said pulse train by a factor of 16.

9. Apparatus for converting a radiated high frequency output signal from a reference oscillator employed in an electronic timepiece to an audible signal corresponding to the ticking rate of a conventional mechanical watch, comprising:

(a) radiation responsive means operative to provide an output signal in the presence of a radiated signal, (b) first dividing means coupled to said radiation responsive means for dividing said output signal by a preselected factor, to provide at an output a divided signal synchronized to said radiated signal, (c) a phase locked loop having a first input coupled and responsive to said divided signal and a second input for application thereto of a second signal to be compared with said divided signal to provide a control signal for said loop, said loop including a VCO for providing an output signal synchronized by said control signal and of a frequency when divided by a given integer, substantially corresponding to said ticking rate of said mechanical timepiece, (d) a second divider coupled to the output of said VCO and operative to divide said output signal by a predetermined factor to provide at an output, a second signal relatively equal in frequency to said divided signal and means for applying said second signal to said second input of said phase locked loop to cause said VCO signal to be synchronized with said divided signal by said control signal, (e) third dividing means coupled to said VCO and operative to divide said synchronized output signal by said given integer to provide at an output of said third dividing means, a signal of a repetition rate relatively equal to said ticking rate, and (f) audio transducer means coupled to the output of said third dividing means for providing an audible signal at said ticking rate.

10. The apparatus according to claim 9 further including means responsive to the presence of said radiated signal for providing an operating signal for disabling said audible signal when a radiated signal is not present.

* * * * *